United States Patent [19]

Miyahara

[11] 3,980,415

[45] Sept. 14, 1976

[54] BURNER FOR BURNING LIQUID FUEL IN GASIFIED FORM

[75] Inventor: Kingo Miyahara, Tokyo, Japan

[73] Assignee: Dowa Co., Ltd., Tokyo, Japan

[22] Filed: Apr. 16, 1975

[21] Appl. No.: 568,710

[30] Foreign Application Priority Data

| | | |
|---|---|---|
| Apr. 24, 1974 | Japan | 49-46726 |
| July 15, 1974 | Japan | 49-83533 |
| July 15, 1974 | Japan | 49-83534 |
| Sept. 24, 1974 | Japan | 49-115053 |
| Jan. 15, 1975 | Japan | 50-7352 |
| Feb. 1, 1975 | Japan | 50-15234 |

[52] U.S. Cl. ..... 431/168; 239/214.25; 431/210

[51] Int. Cl.[2] ..... F23D 11/04

[58] Field of Search ..... 431/168, 210, 190, 8; 239/214.17, 214.25

[56] References Cited

UNITED STATES PATENTS

| | | | |
|---|---|---|---|
| 1,572,591 | 2/1926 | Cannon | 431/168 |
| 3,021,892 | 2/1962 | Brula | 431/168 X |

*Primary Examiner*—Edward G. Favors

*Attorney, Agent, or Firm*—Hill, Gross, Simpson, Van Santen, Steadman, Chiara & Simpson

[57] ABSTRACT

A burner wherein a fuel gasifying member is non-rotatably mounted and disposed in spaced juxtaposed relationship to a gas accumulation chamber formed in a main body of the burner receiving an air supply duct inserted through one side, and liquid fuel scattering means is rotatably mounted at an open end portion of the fuel gasifying member for scattering a liquid fuel in minuscule particles into the interior of the fuel gasifying member and the main body of the burner through a scattering gap. A skirt formed therein with gas ejection slits is mounted at the periphery of the liquid fuel scattering means and has a lower half portion received in the gas accumulation chamber to define a forwardly directed annular gas ejection passageway between the skirt and gas accumulation chamber. A cylindrical air guide may be mounted within the fuel gasifying member and maintained in communication with the air supply duct. A cooling air passageway communicating with the air supply duct may be provided in an outer marginal portion of the main body of the burner, while a scattering surface of the liquid fuel scattering means may be inclined outwardly so as to cause the gas ejection passageway to incline outwardly, by eliminating the skirt. The gas ejection slits in the skirt may be inclined in any direction and the skirt itself may be inclined inwardly, so that the gas ejection passageway may be inclined outwardly. By virtue of these arrangements, the flames of combustion of the fuel in gasified form can be kept from being concentrated on the fuel gasifying member, so that it is possible to avoid damage which would otherwise be caused to the fuel gasifying member by the flames of combustion. An air ejection chamber may be formed outside the gas accumulation chamber and maintained in communication with the cooling air passageway for ejecting air under pressure toward the inner surface of the main body of the burner. By this arrangement, an air stream can be supplied to a portion of the inner surface of the main body of the burner on which the liquid fuel scattered in minuscule particles impinges, so that the liquid fuel in minuscule particles can be kept in fluid condition and its ignition and combustion can be facilitated.

5 Claims, 15 Drawing Figures

BURNER FOR BURNING LIQUID FUEL IN GASIFIED FORM

I have previously developed a burner for burning liquid fuel in gasified form in which a fuel gasifying member is non-rotatably mounted in the main body of the burner. Even if the fuel gasifying member is non-rotatable and remains stationary, the burner of the type described above can be automatically and positively switched from combustion of the liquid fuel in atomized particles to combustion thereof in gasified form, without requiring to burn the liquid fuel in atomized particles beforehand in the fuel gasifying member or without using electrically heating means, so that the liquid fuel can burn satisfactorily in gasified form by producing blue flames.

The burner for burning liquid fuel in gasified form which has previously been developed is constructed in its basic form such that the fuel gasifying member is non-rotatably mounted in the main body of the burner which includes a gas chamber formed in its outer marginal portion. In this type of the burner, all the flames of combustion of the liquid fuel in gasified form are concentrated, after the burner has been switched to combustion of the fuel in gasified form, on the central portion of the main body of the burner in which the fuel gasifying member is located, and the fuel gasifying member is bodily heated vigorously from its surroundings by the flames. As a result, the fuel gasifying member is damaged by being heated more than is necessary. Besides, if the temperature of the fuel gasifying member is raised to a level which is higher than is necessary, then the liquid fuel ejected in atomized particles against the inner wall surface of the fuel gasifying member is not vaporized and gasified but converted into droplets, so that the liquid fuel flows downwardly in droplet form. Because of this, the volume of a gasified fuel produced in the fuel gasifying member varies from time to time and it is consequently impossible to maintain the volume of combustion of the fuel in a constant level. In addition, concentration of the flames of combustion of the fuel in gasified form on the central portion of the main body of the burner as aforesaid prevents the flames of combustion of the fuel in gasified form from being ejected forwardly to extend over a long distance, with the flames remaining in the main body of the burner. This not only brings about early damage to the main body of the burner by the flames of combustion but also sets limits to the use to which the burner is put as a heating source device.

In the burner for burning liquid fuel in gasified form of the aforesaid type, the gas chamber is formed by mounting along inner periphery of the main body of the burner in spaced-apart relationship a combustion board which is formed therein with a multitude of gas ejection ports. This construction requires a lot of labor and material and consequently increases the production cost of the burner.

Accordingly, a main object of the present invention is to provide a burner for burning liquid fuel in gasified form which can be automatically and quickly switched from combustion of the liquid fuel in atomized particles to combustion thereof in gasified form so as to sustain combustion of the liquid fuel in gasified form without interruption, even if the fuel gasifying member is non-rotatably mounted in the main body of the burner, and which enables the flames of combustion of the liquid fuel in gasified form to scatter and to be ejected in various directions whereby heating of the fuel gasifying member more than is necessary can be avoided by increasing the area where the flames of combustion are produced and by preventing concentration of the flames.

Another object of the invention is to provide a burner for burning liquid fuel in gasified form which is low cost, simple in construction, and long in service life because the materials used for fabricating various parts of the burner are resistant to damage by the flames of combustion.

Another object of the invention is to provide a burner for burning liquid fuel in gasified form wherein a gas accumulation chamber is provided on the inner bottom wall side of the main body of the burner which has an air supply duct inserted through one side thereof, and wherein the fuel gasifying member open at one end is non-rotatably mounted in the main body of the burner, the fuel gasifying member being disposed in spaced-juxtaposed relationship to the gas accumulation chamber and liquid fuel scattering means being interposed between the fuel gasifying member and the gas accumulation chamber whereby the burner can be readily switched from combustion of the liquid fuel in atomized particles to combustion thereof in gasified form.

Another object of the invention is to provide a burner for burning liquid fuel in gasified form wherein the liquid fuel scattering means rotatably mounted at the open end of the fuel gasifying member is provided at its outer side with a skirt which is formed therein with a multitude of gas ejection slits and which has a lower portion received in the gas accumulation chamber to define between the skirt and the gas accumulation chamber a gas ejection passageway which is annular in shape and oriented forwardly. By this arrangement, not only combustion of the liquid fuel in atomized particles but also combustion thereof in gasified form can be promoted, and the flames of combustion can be ejected forwardly to extend over a long distance in various directions along outer periphery of the fuel gasifying member whereby the area heated by the flames of combustion can be increased, concentration of the flames of combustion in one position can be prevented and damage to the fuel gasifying member by the flames of combustion can be prevented.

Still another object of the invention is to provide a burner for burning liquid fuel in gasified form which comprises a cylindrical air guide arranged within the fuel gasifying member and disposed in spaced-juxtaposed relationship to the air supply duct which is inserted in the main body of the burner or gas accumulation chamber, so that the gasified fuel produced in the fuel gasifying member and the air blast supplied under pressure through the air supply duct can be mixed well and a gasified fuel-air mixture of perfect proportions produced in this way can be supplied to the gas accumulation chamber.

Still another object of the invention is to provide a burner for burning liquid fuel in gasified form wherein the liquid fuel scattering means rotatably mounted at the open end portion of the fuel gasifying member has a scattering surface which is bent such that it is directed obliquely outwardly, and wherein the gas ejection passageway formed between the liquid fuel scattering means and the gas accumulation chamber is also directed obliquely outwardly. By this arrangement, the liquid fuel can be positively caught by the scattering surface and scattered in atomized particles into the main body of the burner to promote combustion of the liquid fuel in atomized particles, and at the same time the flames of combustion of the fuel in gasified form can be directed outwardly away from the fuel gasifying member to avoid damage to the fuel gasifying member by the flames. Besides, part of the air blast supplied under pressure can be made to flow in the marginal portion of the main body of the burner whereby damage to the main body of the burner by the flames of combustion can be prevented and combustion of the fuel can be promoted.

Still another object of the invention is to provide a burner for burning liquid fuel in gasified form wherein the skirt of the liquid fuel scattering means is inclined inwardly to cause the gas ejection passageway to be directed outwardly, and wherein a cooling air passageway is formed in the outer marginal portion of the main body of the burner for causing an air blast to flow therethrough, so that damage to the fuel gasifying member and the main body of the burner by the flames of combustion can be prevented even if they are made of a thin metallic material and at the same time combustion of the fuel can be promoted.

A further object of the invention is to provide a burner for burning liquid fuel in gasified form which comprises an air ejection chamber of the annular shape disposed at the outside of the gas accumulation chamber and maintained in communication with the air supply duct, so that part of the air blast supplied under pressure through the air supply duct can be ejected through an air ejection passageway toward the inner surface of the main body of the burner where the air is agitated and brought to a fluid condition to produce a stream of air in the zone in which the liquid fuel is scattered in atomized particles so as to enable ignition of the liquid fuel in atomized particles to take place positively and quickly.

Additional and other objects and features of the invention will become evident from the description set forth hereinafter when considered in conjunction with the accompanying drawings, in which.

Figure 1:
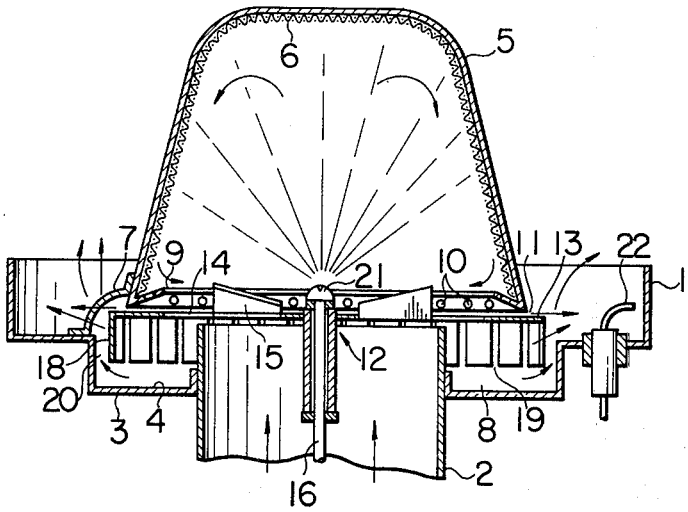
FIG. 1 is a vertical sectional front view, with certain parts being cut out, of a basic form of the burner for burning liquid fuel in gasified form according to the invention.
Figure 2:
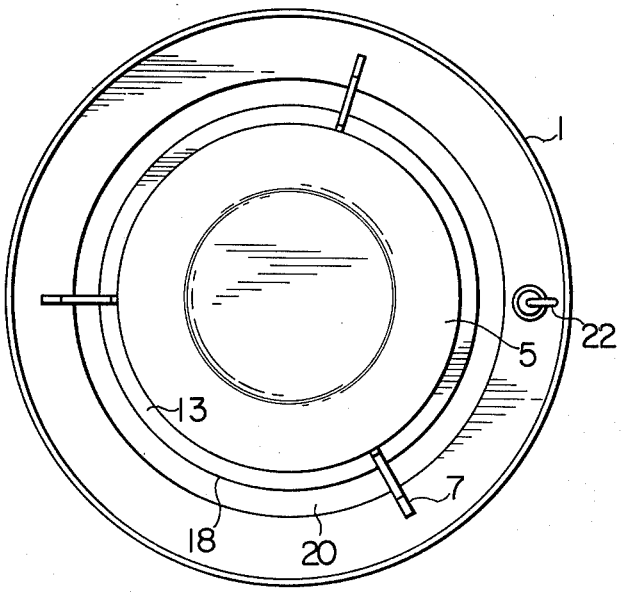
FIG. 2 is a plan view of the burner shown in FIG. 1.
Figure 4:
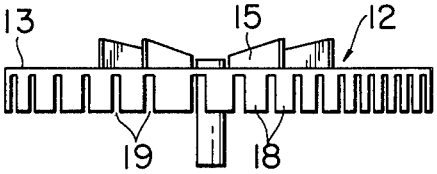
FIG. 4 is a front view of the liquid fuel scattering means shown in FIG. 3.

The basic form of the burner for burning liquid fuel in gasified form according to the invention will now be described with reference to FIG 1. to FIG. 4.

1 refers to a main body of the burner which is open at one end and which receives at the other end an air supply duct 2 inserted and opening therein. The main body 1 of the burner includes an inner bottom wall 3 which is concaved at 4 to form a gas accumulation chamber 8 on the concave portion 4. A fuel gasifying member 5 open at one end and having mounted substantially on the entire inner wall surface thereof a flow-down preventing member 6 made of a wire net is non-rotatably mounted in a position in which the fuel gasifying member 5 is disposed in spaced-juxtaposed relationship to the gas accumulation chamber 8, and connected to the main body 1 of the burner through support bars 7. An inwardly tilting gas-air mixing plate 9 is provided integrally at the edge of the open end of the fuel gasifying member 5, and formed in its periphery with a multitude of fuel outlet ports 10. The gas-air mixing plate 9 may be formed separately from the fuel gasifying member 5.

Figure 3:
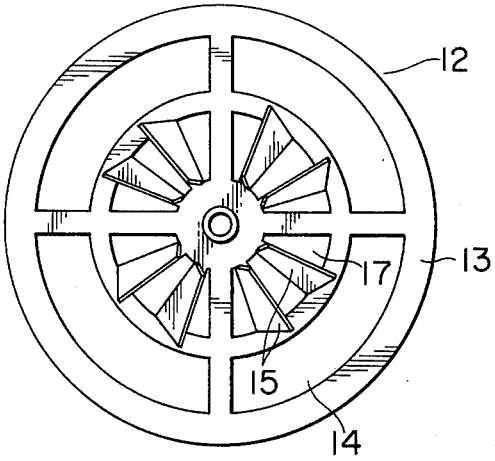
FIG. 3 is a plan view of the liquid fuel scattering means shown in FIG. 1.

Fuel scattering means 12 is rotatably mounted at the open end portion of the fuel gasifying member 5, with a scattering gap 11 of a suitable size being defined between the scattering means 12 and the fuel gasifying member 5. As shown in FIG. 3 and FIG. 4, the liquid fuel scattering means 12 is produced by working on a disk by means of a press and comprises an annular scattering surface 13 disposed at the outermost side, gas passageways 14 disposed inwardly of the annular scattering surface 13, and inclined blades 15 formed by shaving which are disposed at the innermost side. The inclined blades 15 are arranged at the forward open end portion of the air supply duct 2 and supported by a fuel supply line 16 as a shaft such that the blades 15 are caused to rotate by an air blast supplied through the air supply duct 2. Each inclined blade 15 is surrounded by ventilatory openings 17, while the liquid fuel scattering means 12 is integrally provided at its periphery with a skirt 18 which is formed therein with a multitude of gas ejection slits 19. The skirt 18 has a lower half portion which is inserted in the gas accumulation chamber 8 to define between the skirt 18 and the gas accumulation chamber 8 a gas ejection passageway 20 which is annular in shape.

21 is a fuel nozzle provided at the forward end of the fuel supply line 16, and 22 an ignition plug.

In the burner for burning liquid fuel in gasified form constructed as aforementioned, a stream of air blast supplied through the air supply duct 2 under pressure impinges on the inclined blades 15 and causes the fuel scattering means 12 to rotate at high speed while ejected into the fuel gasifying member 5. By supplying a liquid fuel in atomized particles through the liquid fuel nozzle 21, the liquid fuel moves along the inner wall surface of the fuel gasifying member 5 and drops through the fuel output ports 10 onto the scattering surface 13 which is rotating. The liquid fuel thus dropping onto the scattering surface 13 is scattered in atomized particles by centrifugal forces and ignited to initiate combustion of the liquid fuel in atomized particles for heating the fuel gasifying member 5. After combustion of the liquid fuel in atomized particles is initiated, the liquid fuel scattered in atomized particles and moving along the inner wall surface of the fuel gasifying member 5 is caused to diffuse in thin film form by the flow-down prevention diffusing action of the flow-down preventing member 6 and the air blast diffusing action of the stream of air blast supplied under pressure, so that the liquid fuel is vaporized and gasified to produce a gasified fuel in no time at all. The gasified fuel is agitated and mixed with air supplied under pressure while passing through the gas-air mixing plate 9 and the narrow gas passageways 14 to produce a perfect mixture of gasified fuel and air which is introduced under pressure into the gas accumulation chamber 8. Part of the mixture of gasified fuel and air flows through the gas ejection passageway 20 and burns in an annular flame to heat the fuel gasifying member 5. At the same time, the rest of the mixture of gasified fuel and air burns after being ejected obliquely outwardly through the gas ejection slits 19. As a result, the flames of combustion of the liquid fuel in gasified form spread over a zone of large area. This not only reduces the force of the flames but also prevents concentration of the flames on one portion of the fuel gasifying member 5, thereby avoiding damage which would otherwise be caused to the fuel gasifying member 5.

Figure 5:
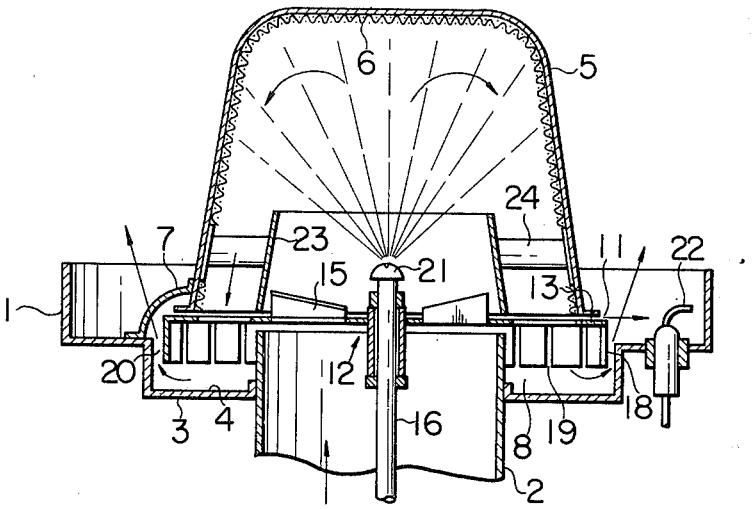
FIG. 5 is a vertical sectional view with certain parts being cut out, of a second embodiment of the invention which ensures that a mixture of gasified fuel and air is produced.

The aforementioned description refers to the basic form of the burner for burning liquid fuel in gasified form shown in FIG. 1 to FIG. 4. A burner for burning liquid fuel in gasified form shown in FIG. 5 provides improvements in the basic form of the burner. The improved burner is not only simpler in construction and lower in cost but also makes it possible to positively gasify the liquid fuel and to produce a mixture of gasified fuel and air, so that combustion of the liquid fuel in gasified form can be effectively sustained for a prolonged interval of time. In the burner shown in FIG. 5, the gas-air mixing plate 9 and the liquid outlet ports 10 provided in the basic form of the burner are eliminated to simplify the construction of the fuel gasifying member 5, and a cylindrical air guide 23 disposed within the fuel gasifying member 5 is fixed to the latter by mounting bars 24 and maintained in communication with the air supply duct 2. By this arrangement, the stream of air blast supplied under pressure through the air supply duct 2 is made to impinge on the inner surface of the top portion of the fuel gasifying member. This has the effect of expediting not only diffusion and movement of the liquid fuel along the inner wall surface of the fuel gasifying member 5 but also vaporization and gasification of the diffused liquid fuel. At the same time, the gasified fuel produced is agitated and mixed with the air supplied under pressure while being introduced smoothly through the cylindrical air guide 23 into the gas accumulation chamber 8 where a mixture of gasified fuel and air of proper proportions can be produced. In this way, it is possible to sustain combustion of the gasified fuel in blue flames in a more favorable and stable manner.

Figure 6:
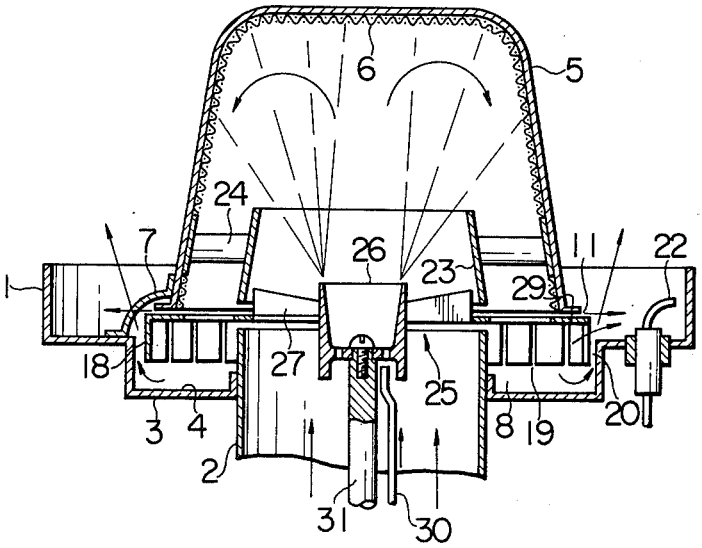
FIG. 6 is a vertical sectional front view, with certain parts being cut out, of the burner according to the invention comprising a modified form of the liquid fuel scattering means.
Figure 7:
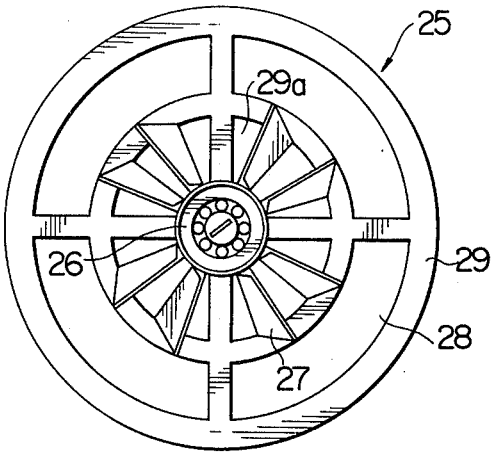
FIG. 7 is a plan view of the liquid scattering means shown in FIG. 5.
Figure 8:
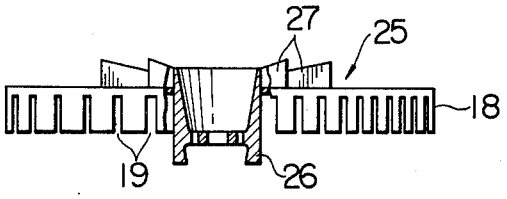
FIG. 8 is a front view of the liquid fuel scattering means shown in FIG 7; with essential portions being broken away.
Figure 9:
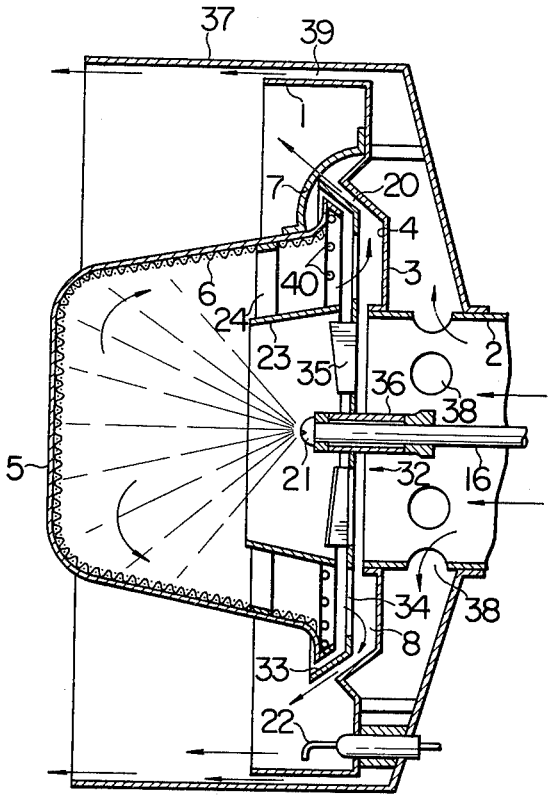
FIG. 9 is a vertical sectional front view, with certain parts being cut out, of a third embodiment of the invention which enables to positively scatter the liquid fuel into the main body of the burner and at the same time to cause the flames of combustion of the liquid fuel in gasified form to be directed outwardly by ejecting the gasified fuel in such direction.
Figure 10:
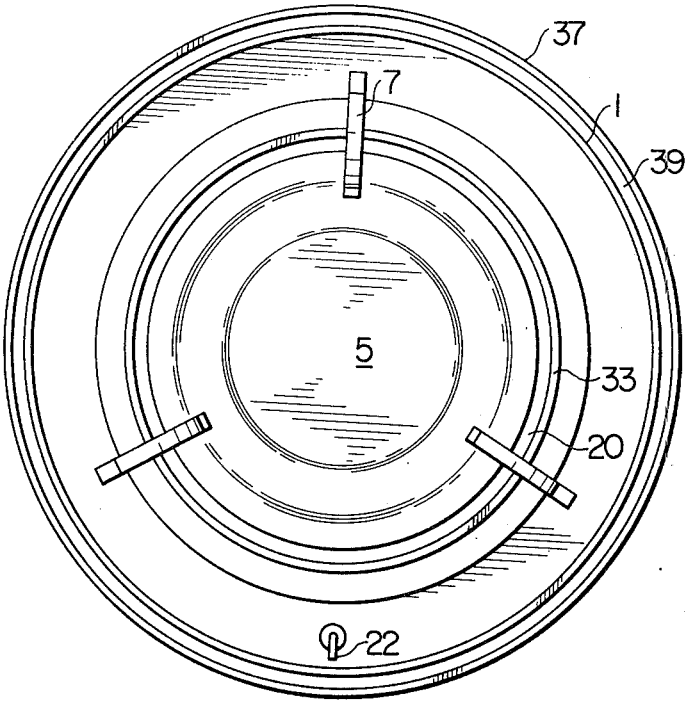
FIG. 10 is a side view of the burner shown in FIG. 9 as seen from the left side of FIG. 9.
Figure 11:
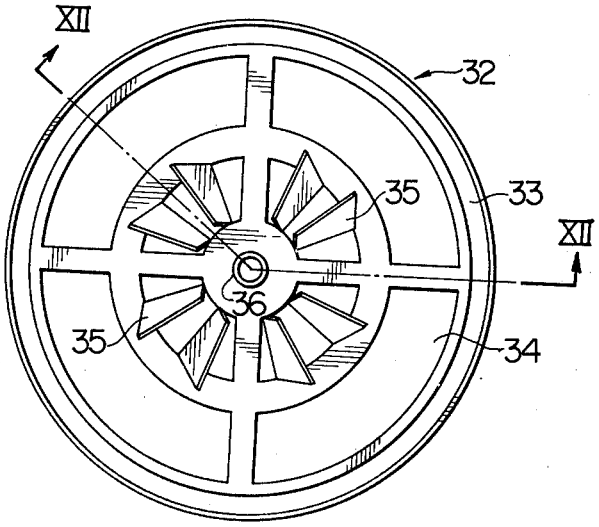
FIG. 11 is a side view of the liquid fuel scattering means shown in FIG. 9.
Figure 12:
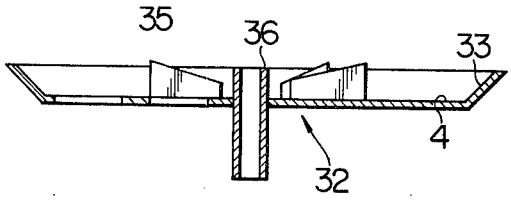
FIG. 12 is a vertical sectional taken along the line XII—XII of FIG. 11.

The fuel gasifying means 12 shown in FIG. 1 to FIG. 5 are of the type which is caused to rotate by the action of the air supplied under pressure through the air supply duct 2. The liquid fuel scattering means 12 may be replaced by liquid fuel scattering means 25 shown in FIG. 6 to FIG. 8 which is constructed such that it can be caused to rotate by means of a suitable electric motor to stabilize the rotation of the fuel scattering means 25. This is conducive to more effective combustion of the liquid fuel in atomized particles and of the liquid fuel in gasified form. More specifically, the liquid fuel scattering means 25, which is fabricated from a disk, comprises a cup-shaped scattering member 26 disposed in the center for ejecting and scattering the liquid fuel in minuscule particles onto the inner wall surface of the fuel gasifying member 5, air-current setting-up blades 27 formed by shaving and disposed outwardly of the scattering member 26, the scattering member 26 and the air-current setting-up blades 27 being disposed within the air supply duct 2, and gasified fuel-air mixture passageways 28 and an annular scattering surface 29 formed integrally with each other and disposed outwardly of the air-current setting-up blades 27. Ventilatory openings 29*a* for permitting substreams of the air blast to pass therethrough are formed in the disk in portions thereof which have been shaved to provide the air-current setting-up blades 27, and a fuel supply line 30 has a forward end portion which is inserted in the liquid fuel scattering member 26 to open therein.

The liquid fuel scattering means 25 constructed as aforementioned is directly supported for forced rotation by a rotary shaft 31 inserted in the air supply duct 2. By supplying a liquid fuel through a fuel supply line 30 simultaneously as the rotary shaft 31 is rotated, it is possible to scatter the liquid fuel in minuscule particles by the cup-shaped scattering member 26 toward the inner wall surface of the fuel gasifying member 5. The liquid fuel which is caused to diffuse and move along the inner wall surface of the fuel gasifying member 5 is scattered in atomized particles into the main body 1 of the burner by the scattering surface 29 to initiate combustion of the liquid fuel in atomized particles. After initiation of combustion of the liquid fuel in atomized particles, the liquid fuel scattered into the fuel gasifying member 5 is quickly converted into gasified form, and the gasified fuel thus produced is mixed with air supplied under pressure to produce a mixture of gasified fuel and air which is ejected in many directions through the gas ejection passageway 20 and gas ejection slits 19 to sustain combustion of the gasified fuel-air mixture.

FIG. 9 to FIG. 12 illustrate a third embodiment of the invention which is a modification of the basic form of the burner according to the invention. In the modified form of the burner, the liquid fuel moving along the inner wall surface of the fuel gasifying member 5 forward its open end is positively caught by fuel scatterimg means 32 which is not provided with a skirt and scattered in atomized particles into the main body 1 of the burner. The liquid fuel thus scattered in atomized particles can be positively ignited and burned, and the mixture of gasified fuel and air produced by heating the fuel gasifying member 5 by the flames of combustion of the liquid fuel in atomized particles can be ejected and burned in flames which are directed outwardly to avoid damage by the flames of combustion to the fuel gasifying member 5 as much as possible. In addition, part of the air supplied under pressure can be made to flow along the outer marginal portion of the main body 1 of the burner to prevent damage which would otherwise be caused thereto by the flames of combustion. Thus, in the third embodiment of the invention shown in FIG. 9 to FIG. 12, the liquid fuel scattering means 32 interposed between the fuel gasifying member 5 and the gas accumulation chamber 8 is devoid of the skirt 18 which is provided in the basic form of the burner and the scattering surface 33 of the scattering means 32 is inclined outwardly, so that the gas ejection passageway 20 is also inclined outwardly.

Thus, the liquid fuel scattering means 32 provided in the third embodiment of the invention, which is fabricated from a disk, comprises a scattering surface 33 disposed at the outermost side, gasified fuel-air mixture passageways 34 disposed inwardly of the scattering surface 33, inclined blades 35 formed by shaving and disposed inwardly of the gasified fuel-air mixture passageways 34, and a boss 36 disposed in the center and through which the liquid fuel scattering means 32 is loosely mounted on the fuel supply line 16. A cylindrical cooling air supply member 37 which has a slightly greater length than the main body 1 of the burner is arranged outside the main body 1 of the burner to define therebetween a cooling air passageway 39 which is connected at one end through air ports 38 to the air supply duct 2. Thus, when the burner is operated to sustain combustion, part of the air blast supplied through the air supply duct 2 flows through the cooling air passageway 38 to thereby cool the main body 1 of the burner.

In the burner for burning liquid fuel in gasified form constructed as aforementioned, the liquid fuel caused to diffuse and move along the inner wall surface of the fuel gasifying member positively flows through fuel outlet ports 40 and drops onto the inclined scattering surface 33 which scatters the fuel in minuscule particles into the main body 1 of the burner to initiate combustion of the liquid fuel in atomized particles. After initiation of combustion of the liquid fuel in atomized particles, the flames of combustion heat the fuel gasifying member 5 and the liquid fuel caused to diffuse and move along the inner wall surface of the fuel gasifying member 5 is vaporized and gasified into a gasified fuel which is agitated and mixed with air supplied under pressure to produce a mixture of gasified fuel and air which is ejected through the outwardly inclined gas ejection passageway 20. Thus, the mixture of gasified fuel and air is ejected in a direction in which the flames of combustion of the fuel in gasified form extend divergently in the main body 1 of the burner. This enables the avoidance of damage by the flames of combustion not only to the fuel gasifying member 5 even if the fuel gasifying member 5 is made of a thin metallic material but also to the main body 1 of the burner even if the main body 1 is made of a thin metallic material, so that combustion of the fuel in gasified form can be sustained satisfactorily.

Figure 13:
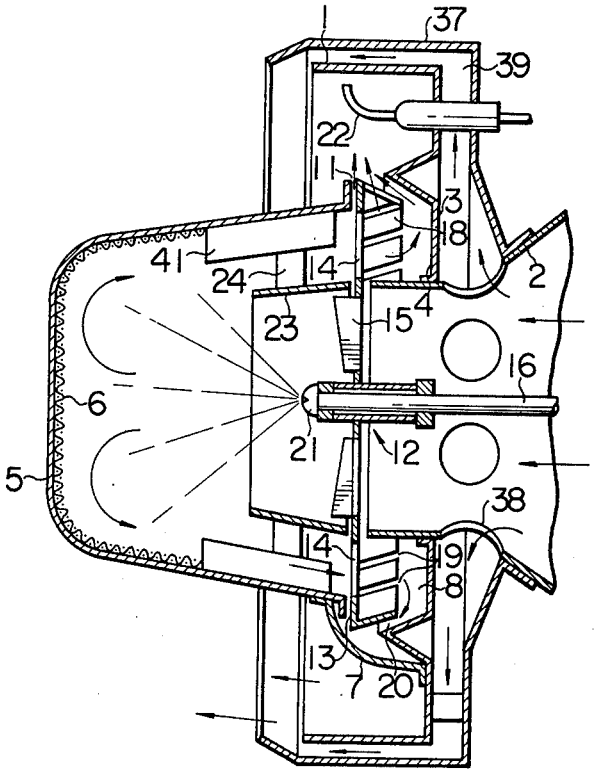
FIG. 13 is a vertical sectional view, with certain parts being cut out, of a fourth embodiment of the invention wherein the liquid fuel scattering means is caused to rotate by the air pressure of a stream of air supplied under pressure.

FIG. 13 shows a fourth embodiment of the invention which comprises the same liquid fuel scattering means 12 that is used in the basic form of the burner according to the invention and provided with the skirt 18, and which is yet capable of accomplishing the same object as the third embodiment of the invention. More specifically, the skirt 18 of the fourth embodiment is formed therein with the inclined gas ejection slits 19 and the skirt 18 as a whole is inclined inwardly. At the same time, the inner bottom wall 3 forming the gas accumulation chamber 8 is inclined at the same angle of inclination as the skirt 18, so that the gas ejection passageway 20 will be inclined outwardly. This enables the mixture of gasified fuel and air to be ejected and burn in flames which extend divergently in many directions, thereby enabling the avoidance of damage to the fuel gasifying member 5 and the main body 1 of the burner by the flames of combustion. A plurality of guide blades 41 are secured to the inner wall surface of the fuel gasifying member 5 and disposed equidistantly from one another so as to promote agitation and mixing of the gasified fuel with air supplied under pressure.

In the first to fourth embodiment of the invention shown and described above, no air stream for agitating and moving the liquid fuel scattered in atomized particles into the main body of the burner is noticeably created in a portion of the interior of the main body 1 where the liquid fuel is scattered in atomized particles by the liquid fuel scattering means, when combustion of the fuel in atomized particles is initiated. The liquid fuel, even if it is converted into atomized particles, cannot be positively ignited and burned even if the ignition plug is operated, unless the liquid fuel in atomized particles is in fluid condition. It is thus essential that the scattered fuel be in fluid condition to ignite the same positively.

In all the embodiments described above, it is through the gas ejection passageway 20 that a stream of air is ejected under pressure. The gas ejection passagway 20 is directed either forwardly or obliquely outwardly. Thus, no air stream is created by the ejected air in a position in which the scattered fuel impinges on the main body 1 of the burner. This keeps ignition of the liquid fuel in atomized particles from being effected satisfactorily, so that it is not possible to positively initiate combustion of the liquid fuel in atomized particles.

Figure 14:
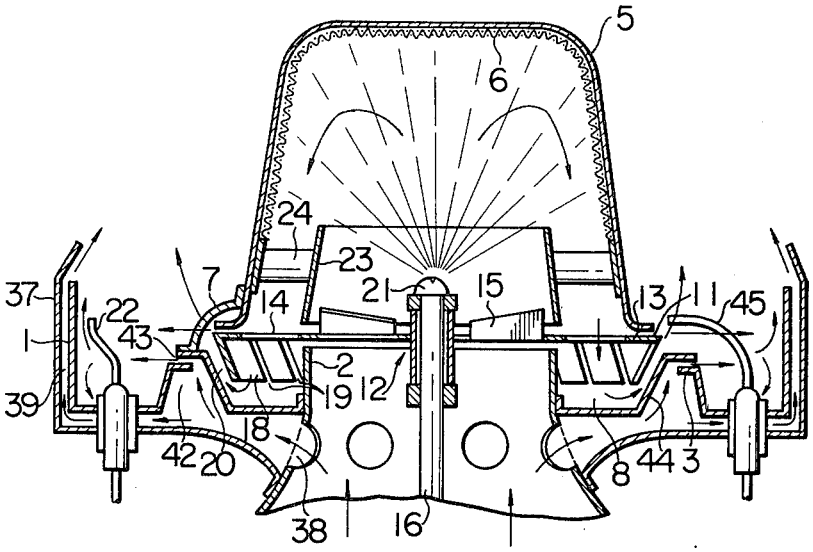
FIG. 14 is vertical sectional view, with certain parts being cut out, of a fifth embodiment of the invention wherein the liquid fuel scattering means is caused to rotate by the pressure of a stream of air supplied under pressure.
Figure 15:
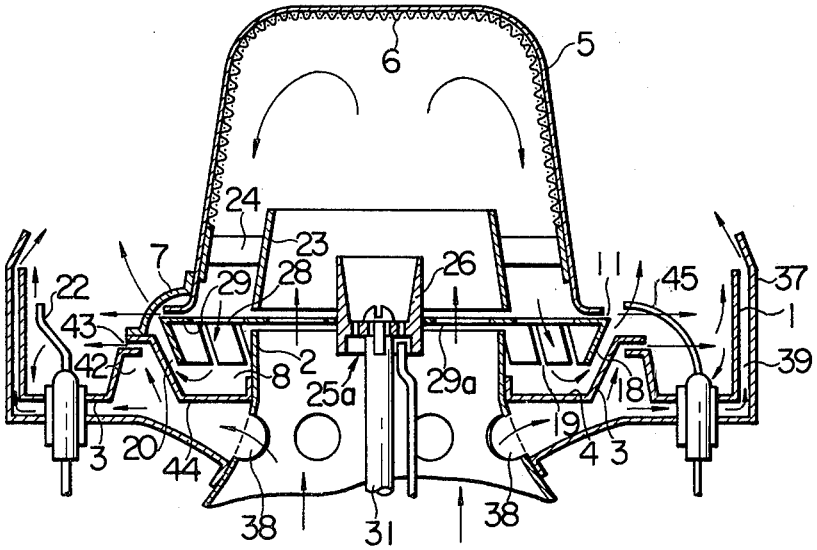
FIG. 15 is a vertical sectional view, with certain parts being cut out, of the fifth embodiment wherein the liquid fuel scattering means is forcedly driven to rotate.

With a view to providing improvements in initiating combustion of the liquid fuel in atomized particles, a fifth embodiment of the invention shown in FIG. 14 and 15 has been developed. The feature provided by the fifth embodiment is the provision of an annular air ejection chamber 42 disposed outwardly of the gas accumulation chamber 8 arranged substantially in the center of the main body 1 of the burner, such air ejection chamber 42 being maintained in communication with the cooling air passageway 39 for cooling the main body 1 of the burner and capable of ejecting, through an air ejection passageway 43 disposed at one side of the air ejection chamber 42, part of the air supplied under pressure. The air ejected is directed toward a portion of the inner surface of the main body 1 of the burner which is disposed slightly below the position in which the liquid fuel is scattered. Thus, a stream of air for agitating and moving the scattered liquid fuel inside the main body 1 of the burner can be created. In the embodiment shown in FIG. 14, when the liquid fuel is scattered into the fuel gasifying member 5 by the liquid fuel scattering means 12 which is forcedly rotated, the scattered fuel is agitated and moved by a stream of air created by the air ejected through the air ejection passageway 43 under pressure. The liquid fuel in fluid condition can be quickly ignited, so that initiation of the liquid fuel in atomized particles can be expedited.

The aforesaid air ejection passageway 43 is formed by merely placing a wall plate 44 for forming the gas chamber 8 and the inner bottom wall 3 of the main body 1 in spaced juxtaposed relationship such that the passageway 43 opens toward the inner surface of the main body 1 of the burner.

The fifth embodiment of the invention described above can achieve the same results by using liquid fuel scattering means of the burner shown in FIG. 15. More specifically, the liquid fuel scattering means shown in FIG. 15 is similar to the liquid fuel scattering means 25 shown in FIG. 6 to FIG. 8 except that the former lacks the air-current setting-up blades 27 of the latter, and the liquid fuel scattering means 25*a* shown in FIG. 15 is directly supported by a rotary shaft 31 for forced rotation so as to sustain combustion of the fuel in gasified form. In this embodiment, an ignition plug 45 for initiating combustion of the fuel in gasified form is arranged in the gas ejection passageway 20.

From the foregoing description, it will be appreciated that the burner for burning liquid fuel in gasified form constructed as aforementioned is capable of quickly and positively scattering in minuscule particles into the main body 1 of the burner a supplied liquid fuel by means of the rotating liquid fuel scattering means, although the fuel gasifying member 5 arranged in the main body 1 of the simple construction is non-rotatable and remains stationary. The liquid fuel scattered in atomized particles in this way is burned to heat the fuel gasifying member 5, so that the liquid fuel supplied thereafter can be converted into gasified form and made into a mixture of gasified fuel and air in the fuel gasifying member 5. The mixture of gasified fuel and air produced in this way can be ejected from the gas accumulation chamber 8 through a gas ejection passageway 20 and the gas ejection slits 19 in many directions and can be burned in flames which extend forwardly for a long distance. Thus, it is possible to avoid damage to the fuel gasifying member 5 by the concentration of flames of combustion because the area of the zone heated by the flames combustion can be increased, and to automatically switch the burner from combustion of the liquid fuel in atomized particles to combustion thereof in gasified form. Moreover, the provision of the cylindrical air guide 23 within the fuel gasifying member 5 which is maintained in communication with the air supply line 2 is conducive to increased production of a gasified fuel and a mixture of gasified fuel and air. Furthermore, according to the invention, the use of the liquid fuel scattering means 32 provided with the outwardly bent scattering surface 33, shown in FIGS. 9 to 12, and the gas ejection passageway 20 which is directed obliquely outwardly to diverge enables it to more effectively scatter the liquid fuel and prevent damage to the fuel gasifying member 5 by the flames of combustion, thereby permitting combustion of the fuel in gasified form to be sustained with a higher degree of efficiency. Also, by arranging at the outside of the gas accumulation chamber 8 the air ejection chamber 42 which is formed with the air ejection passageway 43, it is possible to produce within the main body 1 of the burner a stream of air which agitates the scattered liquid fuel in atomized particles and keeps the same in fluid condition, thereby facilitating ignition and combustion of the scattered liquid fuel. Thus, the burner for burning liquid fuel in gasified form according to the invention is characterized by being high in heating efficiency.

What is claimed is:

1. A burner for burning liquid fuel in gasified form comprising:

a main body of the burner;

an air supply duct inserted in said main body of the burner at one side thereof;

a gas accumulation chamber provided in said main body of the burner;

a fuel gasifying member open at one end which is non-rotatably mounted and disposed in spaced juxtaposed relationship to said gas accumulation chamber, said fuel gasifying member being maintained in communication with said gas accumulation chamber;

liquid fuel scattering means rotatably mounted at the open end of said fuel gasifying member with a scattering gap being defined therebetween;

a skirt disposed at the periphery of said liquid fuel scattering means formed therein with a multitude of gas ejection slits and having a lower half portion received in said gas accumulation chamber; and a gas ejection passageway defined between said skirt and said gas accumulation chamber.

2. a burner for burning liquid fuel in gasified form comprising:

a main body of the burner;

an air supply duct inserted in said main body of the burner at one side thereof;

a gas accumulation chamber provided in said main body of the burner;

a fuel gasifying member open at one end which is non-rotatably mounted and disposed in spaced juxtaposed relationship to said gas accumulation chamber, said fuel gasifying member being maintained in communication with said gas accumulation chamber;

a cylindrical air guide mounted within said fuel gasifying member and maintained in communication with said air supply duct;

liquid fuel scattering means rotatably mounted at the open end of said fuel gasifying member with a scattering gap being defined therebetween;

a skirt disposed at the periphery of said fuel scattering means formed therein with a multitude of gas ejection slits and having a lower half portion received in said gas accumulation chamber; and a gas ejection passageway defined between said skirt and said gas accumulation chamber.

3. A burner for burning liquid fuel in gasified form comprising:

a main body of the burner;

an air supply duct inserted in said main body of the burner at one side thereof;

a gas accumulation chamber provided in said main body of the burner;

a cooling air passageway arranged at an outer marginal portion of said main body of the burner and maintained in communication with said air supply duct;

a fuel gasifying member open at one end which is non-rotatably mounted and disposed in spaced juxtaposed relationship to said gas accumulation chamber, said fuel gasifying member being maintained in communication with said gas accumulation chamber;

liquid fuel scattering means rotatably mounted at the open end of said fuel gasifying member with a scattering gap being defined therebetween, said liquid fuel scattering means including a scattering surface which is bent and inclined outwardly; and a gas ejection passageway defined between said liquid fuel scattering means and said gas accumulation chamber and inclined outwardly.

4. A burner for burning liquid fuel in gasified form comprising:

a main body of the burner;

an air supply duct inserted in said main body of the burner at one side thereof;

a gas accumulation chamber provided in said main body of the burner;

a cooling air passageway arranged at an outer marginal portion of said main body of the burner and maintained in communication with said air supply duct;

a fuel gasifying member open at one end which is non-rotatably mounted and disposed in spaced juxtaposed relationship to said gas accumulation chamber, said fuel gasifying member being maintained in communication with said gas accumulation chamber;

liquid fuel scattering means rotatably mounted at the open end of said fuel gasifying member with a scattering gap being defined therebetween;

a skirt disposed at the periphery of said liquid fuel scattering means formed therein with a multitude of gas ejection slits and inclined inwardly, said skirt having a lower half portion received in said gas accumulation chamber; and a gas ejection passageway defined between said liquid fuel scattering means and said gas accumulation chamber and inclined outwardly.

5. A burner for burning liquid fuel in gasified form comprising:

a main body of the burner;

an air supply duct inserted in said main body of the burner at one side thereof;

a gas accumulation chamber provided in said main body of the burner;

a cooling air passageway arranged at an outer marginal portion of said main body of the burner and maintained in communication with said air supply duct;

a fuel gasifying member open at one end which is non-rotatably mounted and disposed in spaced juxtaposed relationship to said gas accumulation chamber, said fuel gasifying member being maintained in communication with said gas accumulation chamber;

liquid fuel scattering means rotatably mounted at the open end of said fuel gasifying member with a scattering gap being defined therebetween;

a skirt disposed at the open end of said liquid fuel scattering means inclined inwardly and formed therein with a multitude of gas ejection slits, said skirt having a lower half portion received in said gas accumulation chamber;

an inclined gas ejection passageway defined between said liquid fuel scattering means and said gas accumulation chamber;

an air ejection chamber arranged outside said gas accumulation chamber and maintained in communication with said cooling air passageway; and an air ejection passageway for ejecting the pressurized air supplied into said air ejection chamber toward the inner surface of said main body so as to create a stream of air for agitating and moving the liquid fuel scattered in the main body.

* * * * *